US005177315A

United States Patent [19]

Burgess

[11] Patent Number: 5,177,315

[45] Date of Patent: Jan. 5, 1993

[54] REPLACEMENT PRIMER FEEDER FOR SHELL RELOADING MACHINES

[76] Inventor: Terry Burgess, 4881 S. Redwood Rd., Salt Lake City, Utah 84123

[21] Appl. No.: 844,451

[22] Filed: Mar. 2, 1992

[51] Int. Cl.[5] ..... F42B 33/02

[52] U.S. Cl. ..... 86/27; 86/23

[58] Field of Search ..... 86/23, 24, 27, 28, 33, 86/37, 45

[56] References Cited

U.S. PATENT DOCUMENTS 4,027,781 6/1977 Covert ..... 86/37 X 4,766,798 8/1988 David et al. ..... 86/27

*Primary Examiner*—Brian S. Steinberger

*Attorney, Agent, or Firm*—Mallinckrodt & Mallinckrodt

[57] ABSTRACT

Apparatus is provided for use with a conventional shell reloading machine of the type represented by the well-known "Hornady 366 Auto Reloader" commercial machine, such apparatus comprising a carrier holding a plurality of storage tubes filled with respective columns of replacement primers, the carrier being adapted for mounting on the superstructure of the machine in upstanding position so that each tube can be positioned, in turn, relative to that operating station of the machine that is normally occupied by a single such tube for discharging its replacement primers into receiving shells carried therebelow by a turntable of the machine. Removable hitchpins or the like at the bottoms of the respective storage tubes in the carrier prevent the descent by gravity of the respective columns of replacement primers. The hitchpin is removed from the bottom of each storage tube that is placed into primer-discharging position. The carrier is preferably adapted to be rotatably mounted on the machine for rotation in common of the so assembled storage tubes as they are sequentially moved into primer discharging position.

10 Claims, 2 Drawing Sheets

REPLACEMENT PRIMER FEEDER FOR SHELL RELOADING MACHINES

BACKGROUND OF THE INVENTION

1. Field

The invention is in the field of reloader apparatus for spent shotgun shells and is concerned particularly with improving a widely known and used automatic shotgun shell reloader machine.

2. State of the Art

There are many different types of machines on the market for reloading spent shotgun shells with powder and shot after the detonating primers are first removed and replaced with fresh and unspent primers. A machine that is favored by trapshooters and hunters is the "Hornady 366 Auto" produced by Hornady Manufacturing Company, Grand Island, Nebr.

In that machine as presently manufactured, a turntable is mounted on a stationary supporting base for rotation in sequential steps after being raised into operating position relative to a superstructure and to a circular series or array of operating stations thereof by manually operating a reciprocating handle. The turntable provides a circumferential series of notches for receiving the primer-containing, detonating heads of a corresponding series of spent shotgun shells, which heads rest firmly but slidably on the stationary supporting base with the tubular bodies of such shells upstanding, fluted open ends uppermost, for passage below the series of operating stations in the superstructure. Sequential moving of the handle will raise the turntable and advance each spent-shell-receiving notch therebelow from one operating station to a subsequent operating station of the superstructure. An entry station to the side of the series of notches and leading thereinto at the first operating station of the series enables the operator to resize the detonating head of each spent shell and to punch out the used primer therefrom immediately prior to the feeding of such shell into the turntable, and a cam arrangement associated with the final operating station of the series pushes the completely reloaded shell out of the turntable and over a dropout hole in the base.

At the first operating station of the series, a second punch insures that the spent primer is removed from the resized detonating head of the spent shell. Immediately thereafter, a fresh primer is dropped, by gravity from an elongate, vertically positioned supply tube constituting the second operating station of the series, into one of a series of receiving openings in the turntable that alternate with the head-receiving notches so as to be dropped therefrom into a position for filing the punched-out opening of the detonating head of the spent shell in the immediately subsequent notch of the turntable. A measured charge of gun powder is dropped into the fluted open upper end of the spent shell at the next station, a wad is inserted and compressed at the next station, and so on through the other stations of the series until the upper open end of the refilled spent shell is crimped closed and the completely loaded shell is dropped through the extraction hole and into a suitable receiver.

The primer supply tube of the previously described machine is of metal and holds a column of some sixty primers. The person doing the reloading must keep track of the number of shells loaded in a continuing working of the machine, stop the machine when the primers in the supply tube have been used up in the continuing reloading operation of the machine, and then refill the empty primer tube with a new supply of unused primers. Refilling is carried out by use of a filling device supplied with the machine.

Since most users of the machine load many spent shells at a single sitting before the machine, the necessity of periodically refilling the primer supply tube constitutes annoying interruptions in the work. Moreover, the metal tube hides the descending column of primers in the tube and requires undue concentration to determine when continuing operation of the machine should be halted to prevent defective reloaded shells minus primers.

SUMMARY OF THE INVENTION

To overcome the above-mentioned difficulties that are experienced in using the aforedescribed commercial machine, the single metal primer-supply tube is replaced by a multi-tube carrier mounted on and rising above the superstructure of the machine so that replacement primer-filled supply tubes can be sequentially moved into the position previously occupied by the single metal primer-supply tube of the prior machine when required to replace an empty primer-supply tube. Moreover, by making the several tubes of such multi-tube carrier of see-through material, usually of a length of transparent plastic tubing, a glance by the user from time to time at the tube in primer-feeding position will enable him to keep close track of when that tube should be replaced. After moving the carrier so as to place the next tube into feeding position, the empty tube can be refilled with unused primers at the convenience of the user. This is done in conventional manner by use of a standard primer-refilling unit without removing the empty tube from the carrier.

THE DRAWINGS

The best mode presently contemplated for carrying out the invention in actual practice is illustrated in the accompanying drawings, in which:

FIG. 1 represents a perspective view of the aforedescribed commercial machine as modified by replacement of the usual single, metal, primer-supply tube by a rotary, multi-tube carrier holding multiple primer-filled tubes;

FIG. 1A, a fragmentary view in side elevation and partly in vertical section of a spent shotgun shell as held in a receiving recess of the turntable of the machine of FIG. 1, the view being drawn to a larger scale;

FIG. 2, a perspective view of the multi-tube carrier per se with supply tubes for holding replacement primers, the view being drawn to a somewhat larger scale with the support post removed;

FIG. 3, a transverse, horizontal section taken on the line 3—3 of FIG. 2 and drawn to a considerably larger scale; and FIG. 4, a fragmentary view showing the lower end of the multi-tube carrier of FIGS. 2 and 3 secured in place on the machine by means of a center post as in FIG. 1, the view being drawn to the scale of FIG. 3.

DETAILED DESCRIPTION OF THE ILLUSTRATED EMBODIMENT

Figure 1A:
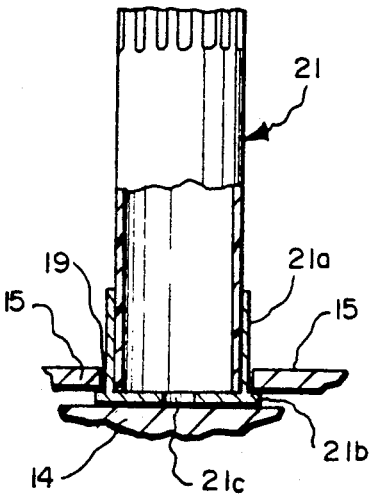
Figure 1:
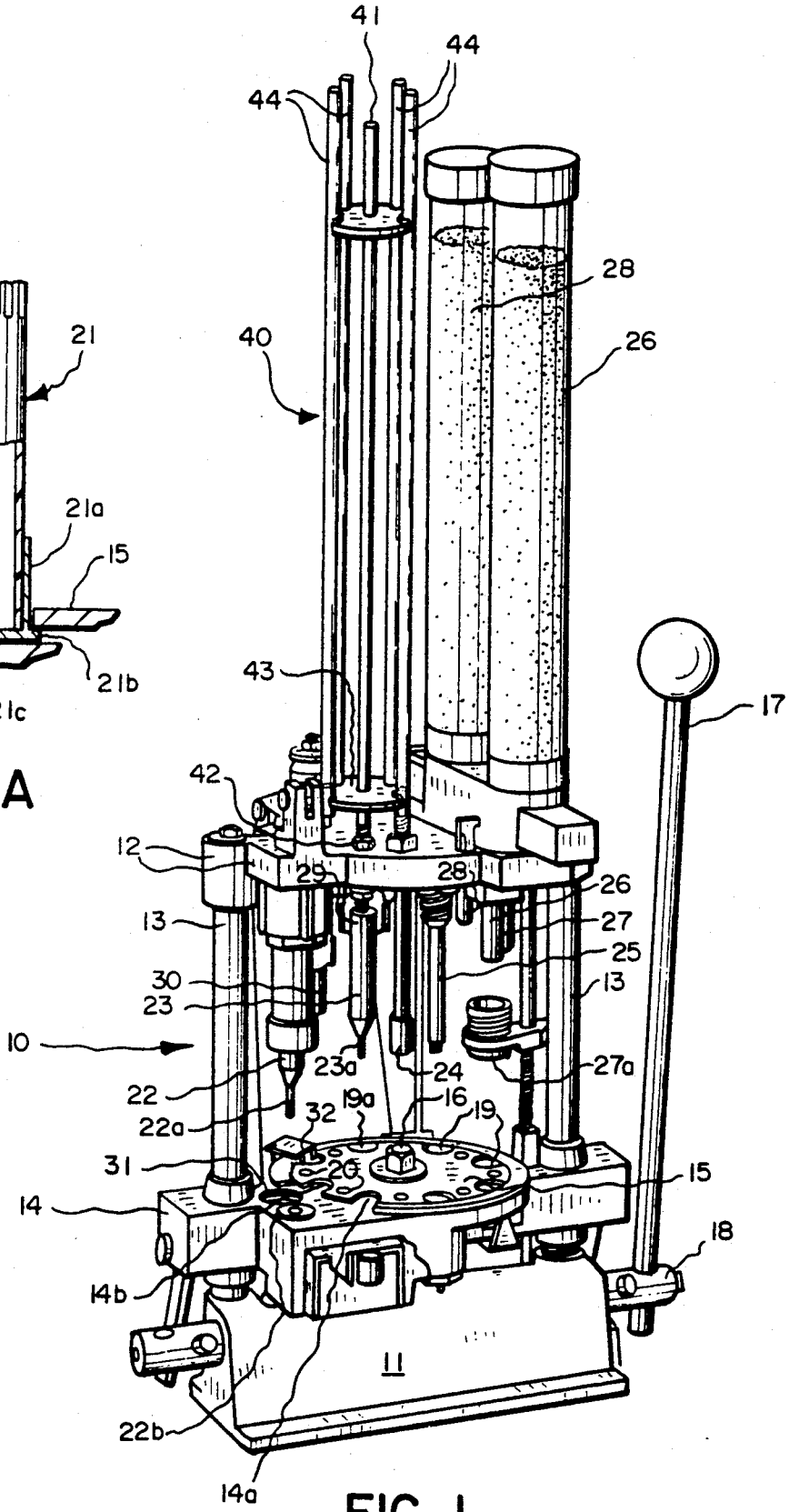

As illustrated and as previously indicated, the well-known Hornady 366 Auto Reloader machine 10, FIG. 1, has a stationary base 11 and a stationary superstructure 12 supported by columns 13 mounted in and rising from base 11. Slidably secured to columns 13 for up and down movement relative to base and superstructure is a structure 14 that includes a turntable 15. Such turntable is periodically and sequentially rotatable about a shaft 16 and is raised and lowered along with structure 14 by mechanism contained in the base and operable manually by pulling on a handle 17 to rotate a main shaft 18.

Turntable 15 has its periphery notched to provide a circumferential series of spent-shotgun-shell-receiving recesses 19 that are open circumferentially of the turntable as they coincide with an entryway 14*a* and an exitway 14*b* on the top of structure 14. Otherwise, they are closed circumferentially by a circular strip 19*a* that is broken only at and to provide the entryway and exitway.

Since the reloader machine 10 is well-known in the shotgun shell reloader art, it is not necessary to describe it in minute detail. Suffice it to say that a series of operative stations, that in general correspond in position to the positions of the recesses 19, are provided by superstructure 12 and that there is also a series of openings 20 in turntable 15 between recesses 19 for receiving replacement primers from a column of same in an elongate supply tube, normally a single metal tube (not shown).

The user of the machine normally sits in front facing the machine as it appears in FIG. 1 and feeds spent shotgun shells 21, FIG. 1A, one by one into turntable 15 through entryway 14*a* following resizing of the usual brass detonator heads 21*a* of such shells at a pre-station located at the side of the turntable, by means of a resizer die 22 having a primer punch member 22*a*, both operating relative to a head-resizer 22*b* at a corresponding position in the top of structure 74.

The resized detonator heads 21*a* of the spent shells 21 rest flatwise on the top of structure 14, with their rims 21*b* overlapped by portions of the turntable marginal to the respective holding recesses 19, see FIG. 1A.

The respective recesses 19 of the series of such recesses of turntable 15, into which the empty shells 21 are fed, are turned counterclockwise in FIG. 1 as structure 14 and turntable 15 are raised toward the operating stations in superstructure 12 by a pull on handle 17, so that a punch 23*a* in the first operating station 23 is brought to bear against the spent primers 21*c* in the resized detonator heads 21*a* of the successively fed shells and punches out such spent primers therefrom if they have not previously been removed by punch end 22*a* of resizing die 22. Meanwhile, turntable 15 is moved around under other operating stations of superstructure 12 which operate, respectively, on any shells 21 that may be in the recesses 19 of turntable 15 in advance of the one into which a shell 21 is being fed through entryway 14*a*. However, the second operating station 24 for supplying replacement primers is correlated in position with the openings 20 of the series of openings that alternate with the recesses 19. A fresh, unused primer from the bottom of the column of such primers provided by the metal supply tube with which the machine 10 is normally equipped falls into a corresponding opening 20, and, on a second pull of handle 17, turntable 15 is rotated to move the recesses 19 into respective positions under corresponding operating station 25, which is a primer seater; under operating station 26, which is a powder feed tube; under operating station 27, which is a wad-compressing punch operating through a wad housing 37*a*; under operating station 28, which is a shot drop tube; under operating station 29, which is a crimp starter for the open upper end of the shell body; and under operating station 30, which is a final crimp die to complete crimping of such open upper end of the shell body. Finally, the completely reloaded shell is pushed off turntable 15, through exitway 14*b* and over a drop-out hole 31 in structure 14 by cam formation of the notches making up recesses 19, for removal from the machine.

The periodic rotations of turntable 15 are effected by a so-called "bear claw" 32 operated by handle 17 through mechanism encased in base 11.

So much for the commercial machine 10 on which the replacement primer supply apparatus of the invention is mounted. Although it is possible that somewhat similar machines could benefit from the invention, the aforedescribed Hornady 366 Auto machine is the only machine presently known to which the present invention is applicable.

Figure 2:
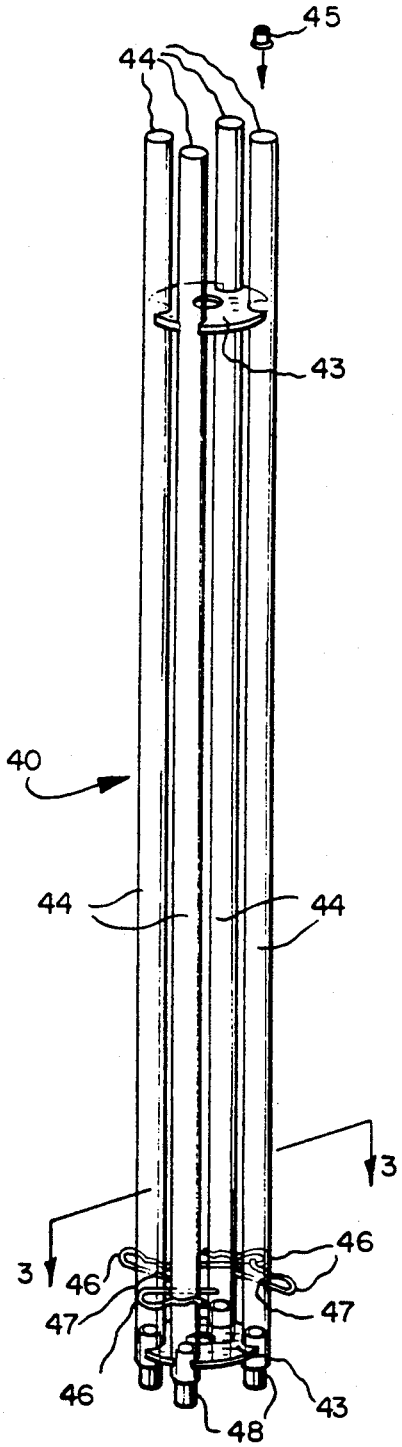
Figure 3:
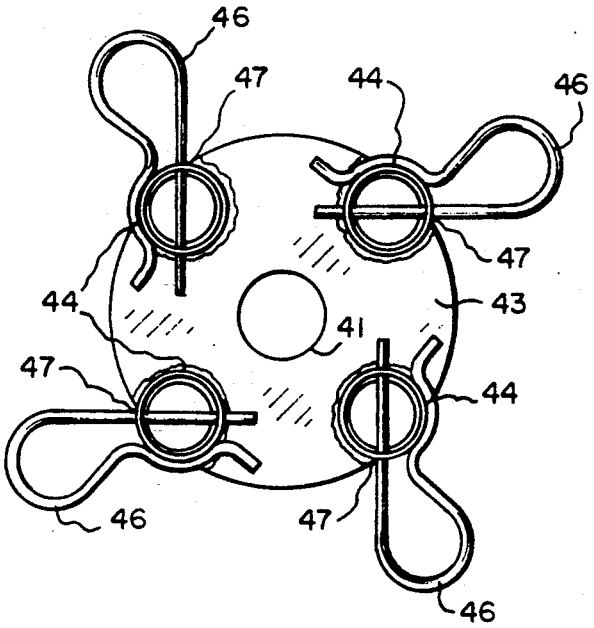

In accordance with the invention, the single, metal, replacement primer supply tube normally used with the machine is replaced by primer feeder apparatus in the form of a multi-tube carrier 40, which in the form here illustrated is sliably mounted on a center post 41 that is threaded at one end for installation in a correspondingly threaded opening provided in the top of the structure 14 of machine 10 and secured tightly in place by a nut 42. Slidable up and down on post 41 are tube-holding plates 43 notched peripherally for receiving and holding a corresponding number of replacement-primer-holding supply tubes 44. Such tubes are preferably, in accordance with the invention, of see-through material such as transparent plastic or, less desirably, glass. The lower open ends of such tubes are normally closed, against descent of the respective columns of replacement primers contained therein, see the showing of a single replacement primer 45 in FIG. 2, by easily removable means such as hitch pins 46, FIGS. 2–4, that are easily obtainable commercially and easily installed in and removed from diametric receiving holes 47 through the tubes 44. With such hitch pins in place, tubes 44 are filled through their open upper ends with respective columns of replacement primers by the usual filling device (not shown) supplied with the machine.

Figure 4:
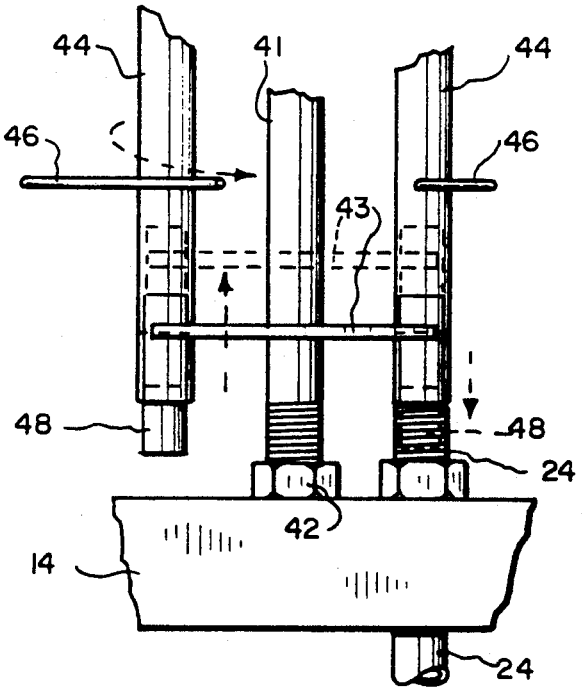

The lower ends of tubes 44 are as here shown provided with respective stub connection tubes 48, having inside diameter slightly greater than the maximum outside diameter of a primer, and outside diameter adapted for insertion in the upper end of the primer feeding tube at operating station 24, see especially FIG. 4, at such times as the carrier 40 is rotated to place one of the tubes into feeding position relative to such operating station. Placement of a tube 44 into feeding position is accomplished by sliding the entire carriage upwardly on center post 41 at the time of carriage rotation to a position at which one of the tubes 44 coincides, i.e. registers, in position with the open entry of the station 24 tube, whereupon sliding the entire carrier 40 downwardly on its center post 41 will effect insertion of the stub tube 48 of the coinciding tube 44 into the open upper end of the station 24 tube with which it is in registry. Hitch pin 46 of that primer supply tube 44 is then removed, allowing the column of replacement primers 45 to descend by gravity as normally takes place with the metal supply tube usually furnished with the machine.

When the user sitting in front of the machine sees through the transparent or translucent see-through material making up the supply tube 44, which is in primer feeding position, that such tube is empty, he again lifts carrier 40 and rotates it on center post 41 to place another of the filled, primer supply tubes 44 into operative primer feeding position. The empty tube can then be refilled at the convenience of the user, using the standard feeding device, without interfering with continuing operation of the machine.

Whereas this invention is here illustrated and described with reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A multitube replacement primer feeder for shell reloading machines normally equipped with a single replacement primer supply and feeder tube, said multitube replacement primer feeder comprising a center post having an end adapted for fastening to the shell reloading machine so the post will stand substantially vertically thereon within an array of shell reloading stations of said machine that includes a replacement primer feed station having a primer receiving opening; carrier means attached to said post for receiving and supporting, circularly around said post, a series of replacement primer supply and feeder tubes in positions such that their lower ends will sequentially register with the primer receiving opening of the replacement primer feed station when said series of tubes are rotated; a series of replacement primer supply and feeder tubes received and supported by said carrier means attached to said post; means whereby said series of tubes may be rotated, so as to periodically replaced an empty tube above said primer receiving opening of the machine with a full tube; and removable and replaceable primary supporting means at the bottoms of the respective tubes.

2. A multitude replacement primer feeder as set forth in claim 1, wherein the primer supply tubes are of see-through material.

3. A multitube replacement primer feeder as set forth in claim 1, wherein the carrier means attached to the post comprises plates spaced apart longitudinally relative to said post, each plate having mutually spaced, peripheral notches into which the respective primer supply tubes are positioned, said plurality of primer supply tubes being rotatable as a group when mounted on the machine.

4. A multitube replacement primer feeder as set forth in claim 1, wherein the means for normally closing the lower ends of the replacement primer storage tubes are hitch pins for fastening in the lower ends of the respective tubes.

5. In combination with a shotgun shell reloading machine that has a stationary base, a spent-shotgun-shell-holding turntable mounted on said base for sequential periodic rotations, and a superstructure above said base and turntable provided with a circular array of operating stations including a station for supplying replacement primers for spent primers removed from spent shotgun shells carried by said turntable, said turntable being raisable and lowerable relative to said superstructure and having a circular series of recesses for receiving and holding a corresponding series of spent shotgun shells and a series of recesses interposed between said shell receiving recesses for receiving replacement primers, the recesses of said series being in respective positions corresponding to the positions of said operating stations during periodic rests between said sequential periodic rotations, a multitube replacement primer feeder, comprising a center post having an end adapted for fastening to the shell reloading machine so as to stand substantially vertically thereon within an array of shell reloading stations that includes a replacement primer feed station having a primer receiving opening; carrier means slidably attached to said post for receiving and supporting, circularly around said post, a series of replacement primer supply and feeder tubes in positions such that their lower ends will sequentially register with the said primer receiving opening of the replacement primer feed station when said series of tubes are rotated; a series of replacement primer supply and feeder tubes received and supported by said carrier means; means whereby said carrier means and said series of tubes held thereby may be rotated, so as to periodically replace an empty tube with a full tube; means for raising and lowering said turntable relative to said superstructure; and removable and replaceable primer supporting means adjacent to the bottoms of the respective tubes.

6. The combination set forth in claim 5, wherein there are additionally included relatively short connection tubes at the lower ends of the primer supply and feeder tubes, respectively, for interconnection with the replacement primer feed station when the turntable is raised relatively to the superstructure.

7. The combination set forth in claim 5, wherein the primer supply tubes are of see-through material.

8. The combination set forth in claim 5, wherein the means for normally closing the lower ends of the replacement primer storage tubes are hitch pins for fastening in the lower ends of the respective tubes.

9. The combination set forth in claim 5, wherein the carrier means attached to the post comprises plates spaced apart longitudinally relative to said post, each plate having mutually spaced, peripheral notches into which the respective primer supply tubes are positioned, said plurality of primer supply tubes being rotatable as a group when mounted on the machine.

10. The combination set forth in claim 9, wherein there are additionally included relatively short connection tubes at the lower ends of the primer supply and feeder tubes, respectively, for interconnection with the replacement primer feed station when the turntable is raised relatively to the superstructure.

* * * * *